United States Patent [19]

Preuss

[11] 4,369,734

[45] Jan. 25, 1983

[54] VARNISHING ASSEMBLY IN A PRINTING PRESS HAVING SELF-CLEANING FEATURE

[75] Inventor: Friedrich Preuss, Dreieich/Sprendlingen, Fed. Rep. of Germany

[73] Assignee: M.A.N.-ROLAND Druckmaschinen Aktiengesellschaft, Offenbach am Main, Fed. Rep. of Germany

[21] Appl. No.: 242,659

[22] Filed: Mar. 11, 1981

[30] Foreign Application Priority Data

Mar. 17, 1980 [DE] Fed. Rep. of Germany ... 8007271[U]

[51] Int. Cl.[3] ..... B05C 1/02

[52] U.S. Cl. ..... 118/702; 101/425; 118/46; 118/203; 427/428

[58] Field of Search ..... 101/425, 364, 350, 204, 101/208, 210; 118/46, 203, 104, 696, 699, 702, 704

[56] References Cited

U.S. PATENT DOCUMENTS

| | | | |
|---|---|---|---|
| 3,486,448 | 12/1969 | Anderson et al. | 101/425 |
| 3,800,702 | 4/1974 | Roberts | 101/425 |
| 3,896,730 | 7/1975 | Garrett et al. | 101/425 |
| 4,230,067 | 10/1980 | Iwamoto et al. | 118/203 X |

*Primary Examiner*—Edgar S. Burr
*Assistant Examiner*—Moshe I. Cohen
*Attorney, Agent, or Firm*—Leydig, Voit, Osann, Mayer & Holt, Ltd.

[57] ABSTRACT

A varnishing assembly in a printing press for applying a layer of varnish to a sheet on a press cylinder. The assembly includes a varnish fountain made up of a tray and fountain roller with an applicator roller interposed between the fountain roller and the cylinder. Storage tanks are respectively provided for varnish, fresh detergent and used detergent. The tray is equipped with an outlet line and an inlet line for drainage and filling. The outlet line has a two-position shut-off valve and the inlet line has a pump and pump drive motor. A two-position, three-connection drain valve is provided having an inlet connected to the outlet line of the tray end outlets connected to the varnish tank and the used detergent tank. The system also includes a two-position, three-connection fill valve having inlets connected to the varnish tank and the fresh detergent tank and an outlet connected to the tray inlet line. Means are provided for switching the valves and motor to produce a cleaning cycle in which (a) varnish is drained from the tray into the varnish tank, (b) fresh detergent is pumped to the tray from the fresh detergent tank for cleaning up the residual varnish, (c) the used detergent is drained from the tray into the used detergent tank. The drained varnish is subsequently pumped from the varnish tank to the tray for resumption of varnishing.

5 Claims, 9 Drawing Figures

RUN WITH VARNISH

FILL TRAY WITH DETERGENT

DRAIN VARNISH

RUN WITH DETERGENT

FIG. 5
DRAIN
DETERGENT
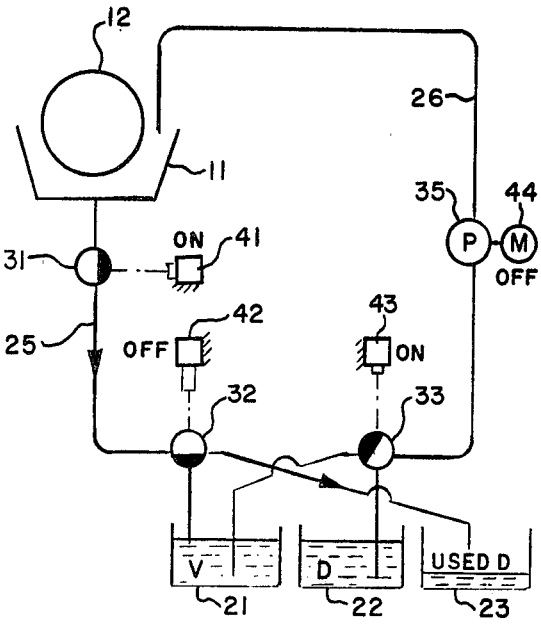
FIG. 6
FILL TRAY WITH
VARNISH
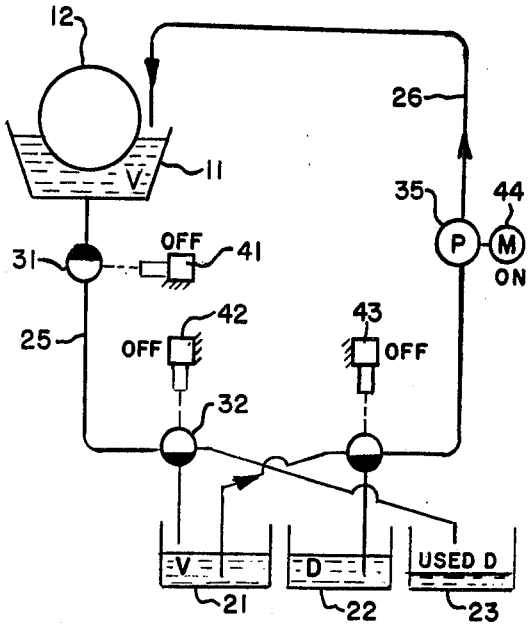
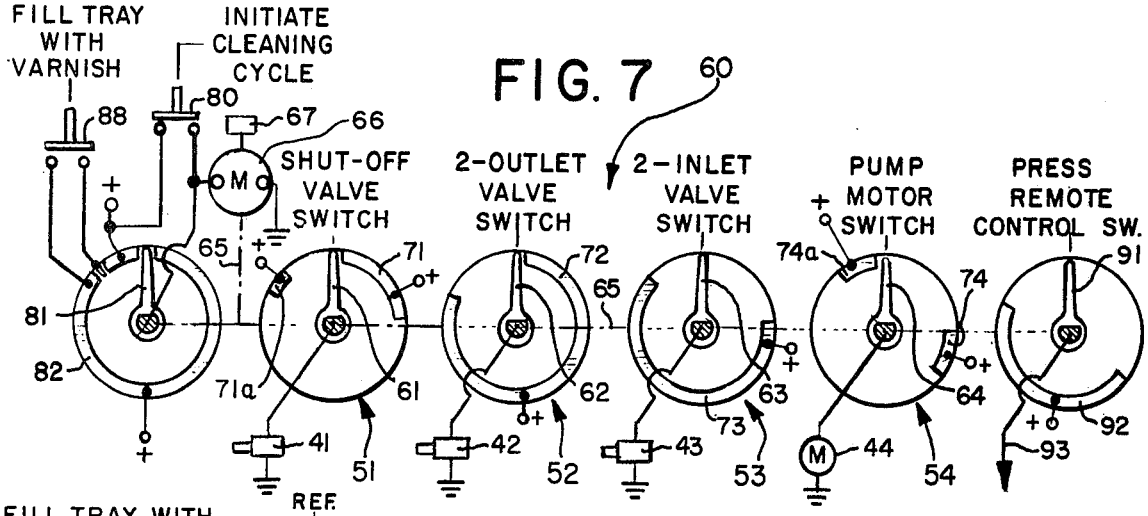
FIG. 7
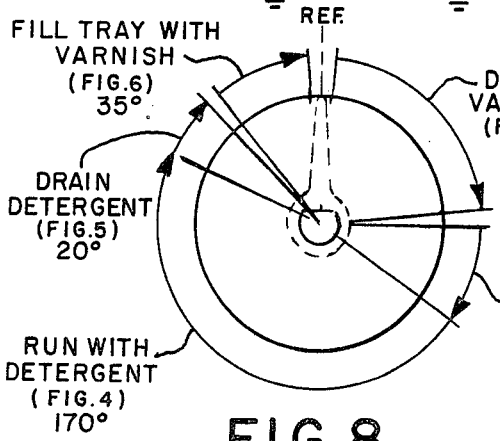
FIG. 8
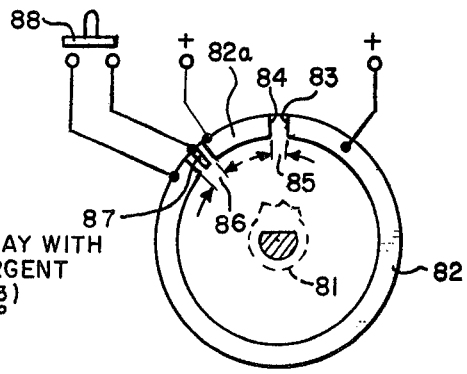
FIG. 9

VARNISHING ASSEMBLY IN A PRINTING PRESS HAVING SELF-CLEANING FEATURE

It has been known to equip a printing press, particularly lithograph press, with a varnishing unit for applying high gloss to the printed product. Upon completion of a printing run or at the end of the work day the varnish must be drained from the tray, and the tray, fountain roller and applicator roller must be thoroughly cleaned using rags with either a solvent or detergent solution. The cleaning up process is laborious and time consuming and considered a disagreeable chore by the pressman. The problem is worsened by the fact that the fountain is difficult of access. As a result cleaning is often slipshod and the fountain becomes contaminated with a sticky residue which gradually builds up in thickness.

It is, accordingly, an object of the present invention to provide a varnishing assembly which is self-cleaning and which does not require the use of manual effort by the pressman. It is a related object to provide a varnishing assembly having a self-cleaning feature which uses only a detergent solution or equivalent and which does not require use of rags which present a disposal problem. It is a general object to provide a varnishing assembly in which the cleaning is more complete and thorough than can be achieved by manual means in accordance with an optimized uniform cleaning cycle.

It is nonetheless an object to provide a varnishing assembly employing only a detergent solution and which is simple and inexpensive to construct and install, utilizing the same plumbing, the same pump and the same motor for the varnish and for the detergent which is used to remove the residual varnish. Thus in addition to cleaning of the varnish fountain, which is the primary purpose of the present invention, the lines, the valves and the pump which carry the varnish are all thoroughly cleaned and renewed simultaneously with, and as an incident to, cleaning of the varnish fountain itself, thus precluding the progressive build-up of sticky residue which usually occurs in the varnish-handling components in the system.

It is a more specific object to provide a varnishing assembly with integral means for valving, pumping and storing both the varnish and the detergent solution and which lends itself to simple and easy remote control of the valves and the pump. It is a more specific object to provide a varnishing assembly which employs two-position, three-connection drain and fill valves actuated by respective solenoids under the control of simple on-off switching circuitry.

In one of the aspects of the present invention it is an object to provide a varnishing assembly in which cyclic control means are provided for automatic sequencing of the valves and pump motor from a reference condition, with pressing of a pushbutton being all that is required to initiate an entire automatic cleaning sequence.

Other objects and advantages of the invention will become apparent upon reading the attached detailed description and upon reference to the drawings in which:

FIG. 5 shows the draining of the detergent.

FIG. 6 shows the subsequent pumping of drained varnish from the varnish tank into the tray for resumption of normal varnishing.

FIG. 7 shows a control device including a set of wiper type switches for energization, in sequence, of the solenoid valves and pump drive motor.

FIG. 8 is a diagram showing the phasing applicable to all of the switches.

FIG. 9 is an enlarged diagram showing the arcuate contact on the cycling switch.

While the invention has been described in connection with certain preferred embodiments, it will be understood that I do not intend to be limited to the particular embodiments shown but intend, on the contrary, to cover the various alternative and equivalent forms of the invention included within the spirit and scope of the appended claims.

Figure 1:
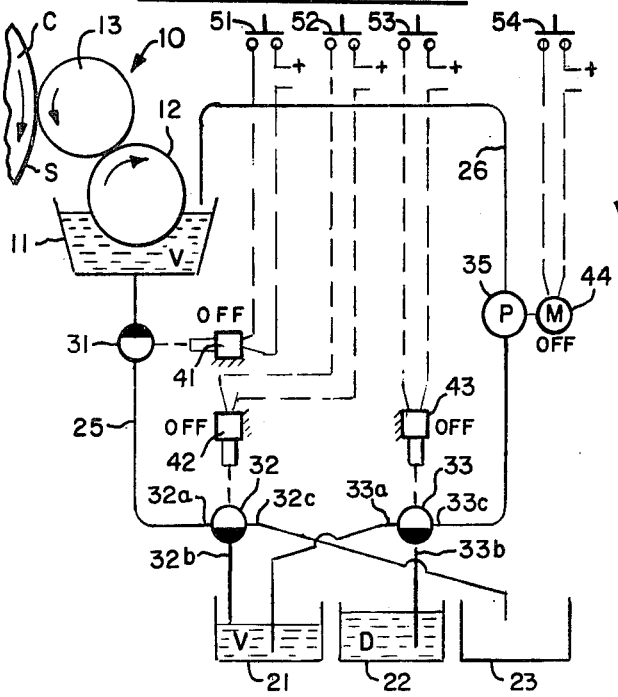
FIG. 1 is a schematic diagram of a varnishing assembly constructed in accordance with the invention shown under normal running conditions.

Turning now to FIG. 1 there is shown a varnishing assembly constructed in accordance with the invention. The assembly is integrated into a printing press adjacent an impression cylinder C which has the usual grippers (not shown) for carrying a sheet S to which varnish is to be applied. The fountain 10 includes a tray 11 carrying a charge of liquid varnish V in which is rotatable a fountain roller 12. Interposed between the fountain roller and the cylinder C is an applicator roller 13. Further details of the varnish fountain need not be shown or described since the art relating to such fountains is highly developed, reference being made to the literature for more complete details.

At the lower portion of the figure three storage tanks are shown diagrammatically. The first tank, indicated at 21 is a varnish storage tank. The second, 22, is a fresh detergent storage tank carrying a quantity of detergent solution D, while the third tank, 23, is a tank for receiving used detergent after it has performed its clean-up function. For removing liquid from the tray 11 of the fountain an outlet line 25 is provided extending from the bottom of the tray, while an inlet line 26 is used for addition of liquid to the tray.

For the purpose of controlling the flow of varnish and detergent a set of valves 31, 32 and 33 are used, a pump 35 being provided for propelling the liquid through the inlet line 26. The valves are actuated by solenoids 41, 42, 43, respectively, which are shown, throughout the figures, in the de-energized (off) or energized (on) states as appropriate to the function being performed. The pump is driven by a motor 44.

The valve 31 in the outlet line 25 is a simple two-position shut-off valve which is preferably closely associated with the tray. The shut-off valve 31 has been illustrated only diagrammatically and may take many different forms without departing from the invention. In the condition shown in FIG. 1 the solenoid is in the "off" condition causing the shut-off valve to block any flow from the fountain tray. Arranged in series with the shut-off valve is the drain valve 32. This is a valve of the two-position, three-connection type, loosely referred to in the literature as a three-way valve, connected so as to have a single inlet connection and alternative outlet connections. Thus the valve has an inlet **32*a*, a first outlet 32*b* connected to the varnish storage tank 21 and a second outlet 32*c* leading to a used detergent tank 23**.

Here again the valve 32 has been diagrammatically shown, and reference is made to the literature for the details of a practical commercial valve. It will suffice to say that when the associated solenoid 42 is turned off, as illustrated, the valve blocks the outlet 32*b* while leaving the alternative outlet 32*c* opened for flow of liquid to the used detergent storage tank. Conversely when the solenoid 42 is turned on the second outlet 32*c* is closed while outlet 32*b* is opened so that flow may take place from the line 25 directly into the varnish tank 21.

Further in accordance with the invention the valve 33, utilized as a fill valve, is in the form of a two-position, three-connection valve having alternative inlet connections and a single outlet connection. Thus the valve 33 has a first inlet 33*a* from the varnish tank 21, a second inlet 33*b* from the fresh detergent tank 22 and an outlet 33*c* which, through the pump 34, supplies the tray inlet line 26. The valve 33 is so constructed that when the associated solenoid 43 is turned off the second inlet 33*b* is blocked while the first inlet 33*a* is opened, the status being reversed when the solenoid 43 is energized, as will appear.

For the purpose of turning the solenoids 41–43, and the motor 44, on and off in various combinations to establish the operating modes set forth in FIGS. 1–6, a simple manual control circuit may be employed or, alternatively, a cyclic control device may be used to provide completely automatic operation as will be discussed subsequently in connection with FIG. 7. The operating mode may be first understood with reference to the simple form of control illustrated in FIG. 1 and which consists of a set of remote pushbuttons 51–54. In the "varnish" mode illustrated in FIG. 1 all of the pushbuttons are in the released state so that the solenoids and pump drive motor are all turned off for normal varnishing of the product.

At the end of the printing run, or at the end of the day, when it is desired to drain and clean the varnish fountain, switches 51, 52 are both pressed thereby turning on the solenoids 41, 42 which reverses the condition of the associated valves 31, 32. Thus the valve 31 will be opened allowing the varnish to drain into the outlet line 25. The valve 32, upon being actuated, blocks off the second outlet connection 32*c* and opens the outlet connection 32*b* so that varnish can drain freely from the tray into the varnish storage tank 21. Buttons 51, 52 are pressed for a sufficient length of time as to permit substantially complete drainage of the varnish to take place.

Figure 3:
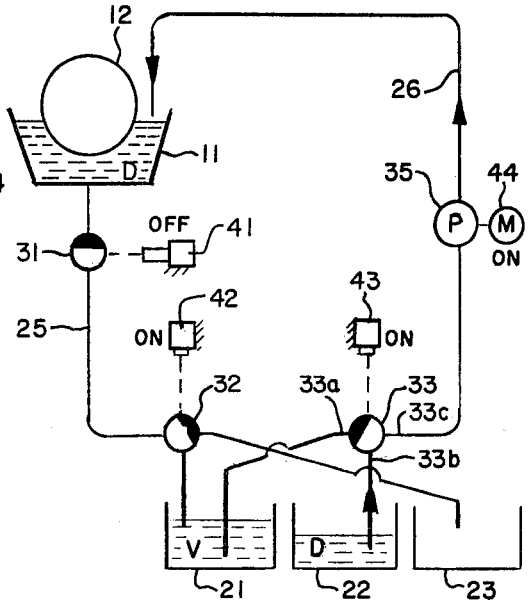
FIG. 3 shows the setting of the valves and actuation of the pump to fill the tray with detergent solution.
Figure 2:
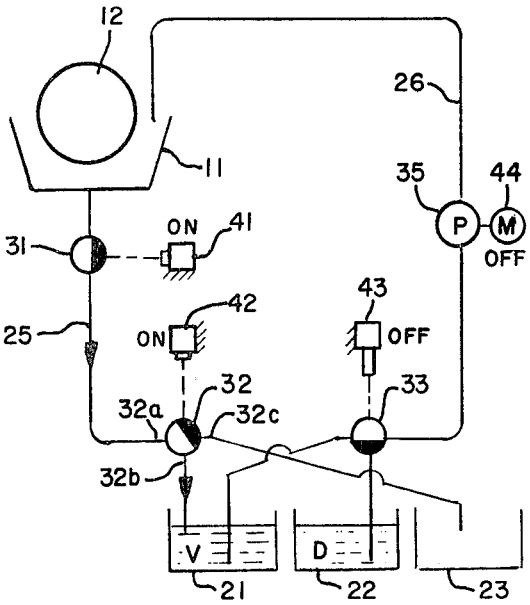
FIG. 2 shows the setting of the valves for the draining of varnish from the fountain tray.

The next mode of operation, shown in FIG. 3, is the filling of the tray 11 of the fountain with the detergent solution. Such solution will be referred to in the following discussion simply as "detergent" for the sake of brevity. To achieve the setting of the valves illustrated in FIG. 3, and to turn on the pump motor, three push button switches 52, 53, 54 are pressed simultaneously thereby energizing the solenoids 42, 43 and causing the pump to rotate. The setting of the valve 32 remains unchanged from the preceding mode, thereby permitting continued drainage of the line 25 into the varnish storage tank. Reversing the setting of the valve 33, by turning on the solenoid 43, has two effects, closure of the first inlet port 33*a* and opening of the second inlet port 33*b* thereby establishing a free flow connection between the detergent storage tank 22 and the pump 35. Thus liquid detergent is drawn from the tank 22 and pumped into tray inlet line 26 which discharges into the tray 11. This setting of the switches is maintained until the detergent is at a desired level in the tray. Where the pump 34 is of the positive displacement type driven at known speed by the motor 44 the total amount of detergent which is pumped into the tray may be gauged by timing the "on" time. Since the degree of fill need only be approximate the "on" time may be mentally gauged by the pressman with adequate accuracy.

Figure 4:
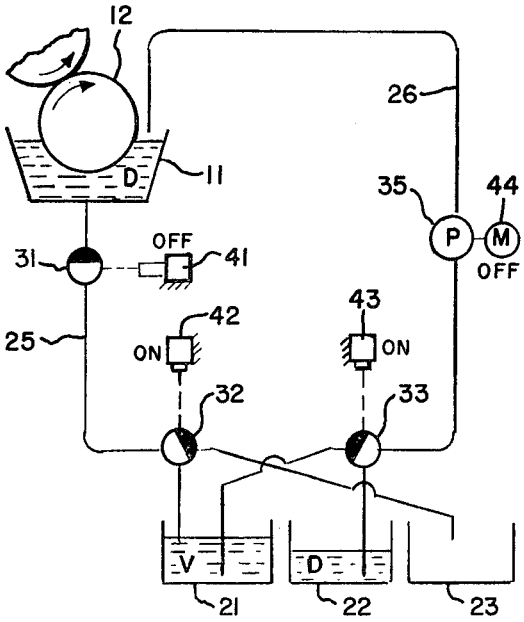
FIG. 4 illustrates the running of the system charged with detergent.

With the tray filled with detergent the push button 54 is released turning the motor 44 off as shown in FIG. 4, establishing the detergent "run" mode. The pushbuttons 52, 53 may be maintained in the depressed state provided it is desired to continue drainage of the line 25 and the portion of the line 26 which leads to the pump; otherwise pushbuttons 52, 53 may be released.

During the condition illustrated in FIG. 4, the fountain roller 12 and applicator roller 13 are revolved in contact with one another, either by rolling engagement with the cylinder C of the printing press or by using an auxiliary motor (not shown) for temporary driving of the rollers. Rotation of the rollers in the tray not only washes the rollers clear of varnish but the circulation of the liquid in the tray washes the sides and bottom of the tray to remove residual varnish therefrom. If desired the rollers may be rotated during this mode of operation at an augmented speed to increase the amount of turbulence in the tray.

The next mode of operation in the sequence, illustrated in FIG. 5, is the draining of the used detergent solution into the used detergent storage tank 23. To bring about this mode of operation pushbutton 51 is depressed turning on the solenoid 41 which opens the valve 31. This provides a free flow path from the tray 11 of the fountain through the valves 31, 32 and into the outlet 32*c* which leads to the used detergent tank 23. While the tray is being drained of its detergent operation of pushbutton 53 is optional. If the pushbutton 53 is depressed, the path is kept open to the detergent storage tank 22 so that any detergent which may remain in the lower portion of the line 26 will drain into the detergent tank rather than into the varnish tank.

After the used detergent has completely drained from the tray into the tank 23 the clean-up portion of the cycle is at an end and all the pushbuttons may be released.

However, where it is desired to resume varnishing, as in FIG. 6, the tray 11 is filled with varnish by the simple expedient of turning on the motor 44 which drives the pump, which can be done by pressing the pushbutton 54. This draws varnish from the varnish storage tank 21 through the first inlet 33*a* of the valve 33 and through the outlet 33*c* from which the varnish is pumped through the inlet line 26. Again assuming that the pump is of the positive displacement type driven at an established speed, the degree of fill of the tray can be gauged by the time interval that the pump is operated. When the tray is full, the pushbutton 54 which controls the motor can simply be released thereby establishing the normal "run" condition which has already been discussed in connection with FIG. 1.

While the push buttons 51–54 have been shown in close association with the fountain simply for the purpose of drafting convenience, it will be understood that such pushbuttons, or equivalent switches, may be clustered at a remote control location, preferably the normal operating station of the pressman.

Remote switching by the operator of the four controlled switches achieves the primary benefits of the invention which is the elimination of manual cleaning employing rags or the like. However, in accordance with one of the aspects of the invention means are provided for automatic sequencing of the valves and pump motor from a reference condition without any care or attention on the part of the operator and with the operator required only to initiate the sequence by pressing a single pushbutton. Such an automatic control arrangement is set forth in FIG. 7 where a series of wiper switches coupled to a common shaft is employed to turn on corresponding solenoids, and the drive motor, in the sequence which has been described above in connection with FIGS. 1-6. However, before discussing the wiper switch arrangement it should be understood that the invention is not limited to use of wiper switches and that such version has been shown only for the sake of easy understanding of the invention. While the arrangement is deemed practical it will be understood that the invention contemplates substitution of solid state circuitry to accomplish the various sequencing and control functions, such substitution being within the scope of one skilled in the art without departing from the invention.

Turning attention now to FIG. 7 there is disclosed a multi-layer wiper switch 60 having wipers 61-63 electrically connected to the solenoids 41-43, respectively, as well as a wiper 64 which is connected to the pump motor 44. The wipers are all rigidly connected to a common drive shaft 65 which is drivingly coupled to a sequencing motor 66. It will be understood that there is interposed between the motor 66 and the shaft 65 a speed reducer (not shown) to provide shaft rotation at a speed which may, in a practical case, be about four or five minutes per revolution under the control of adjusting means 67.

The wipers 61-64 cooperate with arcuate contact segments 71-74 with auxiliary contact segments **71*a*, 74*a* being provided in proper phase relation as required to bring about the modes of operation discussed in connection with FIGS. 5 and 6, respectively. The wipers 61-64 are shown in FIG. 7 in reference position corresponding to the normal running of the press and the varnishing mode illustrated in FIG. 1**. All contact segments are connected to a source of positive voltage.

The switch drive motor 66 is energized through a pushbutton 80 which is used to initiate the cleaning cycle.

In order to remove from the pressman the burden of determining the length of the cycle, means are provided for sealing or holding the motor "run" circuit so that the shaft 65 completes a revolution, or a predetermined portion of a revolution, as will appear, upon pressing the initiate pushbutton 80 only momentarily. This is accomplished by an auxiliary holding switch consisting of a wiper 81 secured to the shaft 65 and which cooperates with an arcuate contact segment 82. As set forth in more detail in FIG. 9, the arcuate contact segment 82 has a beginning 83 and an end 84 which are spaced from one another to form a gap 85 which defines the reference position of the wiper 81 in which the wiper 81 is out of contact with the segment 82. However, when the pushbutton 80 is momentarily depressed turning on the motor 66 to initiate a cleaning cycle, the initial movement of the wiper 81 brings it into engagement with the arcuate contact 82 which thereafter furnishes current to the motor 66 permitting the pushbutton 80 to be released.

The continued rotation of the switch shaft 65 causes the solenoids and motor to undergo the same sequencing as has already been discussed in connection with FIGS. 1-6. However, before reviewing this sequencing it is one of the more detailed features of the invention that the switches may be optionally caused to go through the modes shown in FIGS. 1-5, which completes the cleaning cycle, or to continue around through a full revolution which includes the re-filling of the fountain tray with varnish (FIG. 6). To cause the wiper 81 to automatically come to a stop upon termination of the cleaning cycle, and before re-filling with varnish, the arcuate contact 82 is provided with a second gap 86 (FIG. 9) which divides the arcuate contact into two portions 82 and **82*a*. Thus if it is desired only to complete the cleaning cycle, the gap 86 is left open so that the wiper 81, upon encountering the gap at the end of the FIG. 5 mode, will break contact with the arcuate contact 82 bringing the motor 66 to a stop and terminating the sequence. In order to start the motor 66 up again to proceed into the varnish fill mode of FIG. 6, the gap 86 is occupied by an auxiliary "island" segment 87 which is energized by push button 88** from a source of positive voltage.

Thus, in operation, all the pressman has to do to initiate a cleaning cycle is to momentarily touch push button 80 which causes the wipers to progressively advance through the modes illustrated in FIGS. 1-5 to complete the cleaning cycle, whereupon the wiper 81, striking the gap 86, will turn off the motor 66 without proceeding into the varnish fill mode. It is in this state that the control circuit is left following completion of a job or at the end of the day's work. However, if the pressman desires to re-fill the tray with varnish, momentary pressure on push button 88 energizes the wiper 81 to turn on the motor 66 thereby moving the wiper into contact with the final section **82*a* of the arcuate contact thereby moving all of the wipers through the mode of FIG. 6 and back into the reference position where the wiper 81 strikes the gap 85 turning off the motor 66** and ending the varnish fill cycle.

The manner in which the progressive movement of the switch wiper brings about the successive modes illustrated in FIGS. 1-6 will be readily understood upon considering FIG. 8 in connection with FIG. 7. In FIG. 8 portions of the arc have been identified with the modes shown in the figures set forth.

Thus when the wipers are in the dot-dashed reference position the device is in its varnishing mode with all of the solenoids and motor turned off. Pressing the initiate pushbutton 80 causes the shaft to begin to rotate and, because of the holding contact 82 rotation will continue, with the wipers 61, 62 striking the contact segments 71, 72 to turn on the solenoids 41, 42 to establish the FIG. 2 mode in which the varnish is drained. Such mode exists over an angle of 85 degrees in the present embodiment.

At this point three things occur to place the system in the FIG. 3 mode: First of all the wiper 61 leaves the contact segment 71 to turn off the solenoid 41 and close the shut-off valve 31. Secondly, the wiper 63 strikes the contact 73 to turn on the solenoid 43 to move the valve 33 to its FIG. 3 position providing for flow of detergent from the tank 22 to the pump. Finally, engagement of the wiper 64 with the segment 74 energizes the motor 44 turning on the pump so that fresh detergent is pumped from the tank 22 into the tray. Such pumping persists through an angle of 35 degrees of the shaft 65. This brings the shaft 65 to the 125 degree position where the wiper 64 leaves the segment 74 to turn off the pump leaving the tray filled with detergent as shown in FIG. 4.

During the FIG. 4 mode rotation of the fountain roller 12 and applicator roller 13 cause sufficient circulation of the detergent to clean up the residual varnish. Such running with the detergent persists until the shaft reaches the 295 degree position. At this point, as illustrated in FIG. 5, draining of the detergent is initiated. This comes about by the fact that the wiper 62 leaves the segment 72 thereby turning off the solenoid 42 to establish a path from the tray outlet line 25 through the connection 32*c* to the used detergent tank 23. Simultaneously engagement of the wiper 61 with the contact segment 71*a* turns on the solenoid 41 thereby opening the shut-off valve 31 providing free flow between the tray and the used detergent tank 23 so that the tray is promptly emptied of its detergent.

When the shaft 65 reaches the 315 degree position the wiper 81 enters the gap 86 automatically turning off the motor 66 to terminate the cleaning cycle.

When the pressman wishes to fill the tray with varnish to resume normal printing, it suffices to press the pushbutton 88 which energizes the island contact 87 turning on the motor 66 so that wiper 81 moves out of the gap and into the final mode illustrated in FIG. 6. In this mode the wiper 61 which controls the shut-off valve 31 is without voltage so that the solenoid 41 is de-energized causing the shut-off valve 31 to be in its blocking position; in other words the tray is sealed. At the same time engagement of the wiper 64 with the contact segment 74*a* energizes the motor 44 to turn on the pump so that varnish is drawn through the input connection 33*a* of the valve 33 into the pump from which it flows under pressure through the tray inlet line 26 until the tray is filled with varnish as illustrated in FIG. 6. At this point the wiper 64 leaves the contact 74*a* turning off the motor 44 which drives the pump. Shortly thereafter the wiper 81 of the cycling switch strikes the gap 85 in the arcuate contact 82 to turn off the motor 66, thereby restoring the system to the "run" condition illustrated in FIG. 1 for normal varnishing.

In accordance with one of the more detailed aspects of the present invention means are incorporated in the control for insuring rotation of the fountain roller and applicator roller in the "run with detergent" mode illustrated in FIG. 4. This is accomplished by providing on shaft 65 an auxiliary wiper 91 which engages a contact segment 92 to energize an output line 93 in the FIG. 4 mode. The signal which appears on the output line 93 during the FIG. 4 mode may be put to a number of different uses at the election of the press designer. It may be employed for example simply to light a pilot light to signal to the press man that, when the pilot light is lit, the jog switch of the press should be pressed thereby to insure rotation of the fountain roller and applicator roller. Alternatively the line 93 may be connected to the forward jog circuit of the press to provide automatic press operation during the FIG. 4 mode, thereby making intervention by the pressman unnecessary. Or, if desired, an auxiliary motor (not shown) may be provided for driving the fountain roller and applicator roller during the FIG. 4 mode while the press cylinder remains stationary and preferably at an augmented speed for agitation of the detergent in the tray.

While the cleaning fluid has been referred to as "detergent" for the sake of convenience it will be understood that this term is broad enough to include any liquid, including liquid solvents, capable of washing away or dissolving the residual varnish in the tray or other portions of the system. Where a solvent is used the spent material may be reclaimed; however, where a conventional detergent solution is employed the spent liquid need not be stored and may simply be discharged into a sump or down the drain, with the term "storage tank" being interpreted broadly enough to include both of these possibilities.

It will be apparent that the system described above amply meets the objects of the invention stated earlier.Regardless of whether the assembly is under remote control by manual pushbuttons as in FIG. 1, or fully automatic as in FIG. 7, the disagreeable chore of cleaning out the fountain with use of rags has been completely eliminated. The disclosed cleaning assembly has universal application not only in presses of new design but in presses already in the field which may be retrofitted without making any substantial change in the existing varnishing elements.

It will be understood that the relative lengths of the switch segments illustrated in FIGS. 7 and 8 which cover the times allotted to the respective modes of operation may be adjusted as desired to allow more or less time to a particular mode without departing from the invention.

What I claim is:

1. A varnishing assembly in a printing press for applying a layer of varnish to a sheet on a press cylinder comprising, in combination, a varnish fountain including a tray and fountain roller, an applicator roller interposed between the fountain roller and the cylinder, a varnish storage tank, a fresh detergent storage tank, a used detergent storage tank, the tray having an outlet line and an inlet line, the outlet line having a two-position shut-off valve and the inlet line having a pump and pump drive motor, a two-position three-connection drain valve having (1) an inlet connected to the outlet line of the tray, (2) a first outlet connected to the varnish tank and (3) a second outlet connected to the used detergent tank, a two-position three-connection fill valve having (1) a first inlet connected to the varnish tank, (2) a second inlet connected to the fresh detergent tank and (3) an outlet connected to the tray inlet line, and means for switching the valves and motor to produce a cleaning cycle in which (a) unused varnish is drained from the tray into the varnish tank, (b) fresh detergent is pumped to the tray from the fresh detergent tank for cleaning up the residual varnish, and (c) the used detergent is drained from the tray into the used detergent tank.

2. A varnishing assembly in a printing press for applying a layer of varnish to a sheet on a press cylinder comprising, in combination, a varnish fountain including a tray and fountain roller, an applicator roller interposed between the fountain roller and the cylinder, a varnish storage tank, a fresh detergent storage tank, a used detergent storage tank, the tray having an outlet line and an inlet line, the outlet line having a two-position shut-off valve and the inlet line having a pump and pump drive motor, a two-position three-connection drain valve having (1) an inlet connected to the outlet line of the tray, (2) a first outlet connected to the varnish tank and (3) a second outlet connected to the used detergent tank, a two-position three-connection fill valve having (1) a first inlet connected to the varnish tank, (2) a second inlet connected to the fresh detergent tank and (3) an outlet connected to the tray inlet line, control means including switches having "on" and "off" positions and clustered at a remote control location for energizing the valves and the pump motor to produce a cleaning cycle in which (a) unused varnish is drained from the tray into the varnish tank, (b) fresh detergent is pumped to the tray from the fresh detergent tank for cleaning up the residual varnish, and (c) the used detergent is drained from the tray into the used detergent tank.

3. A varnishing assembly in a printing press for applying a layer of varnish to a sheet on a press cylinder comprising, in combination, a varnish fountain including a tray and fountain roller, an applicator roller interposed between the fountain roller and the cylinder, a varnish storage tank, a fresh detergent storage tank, a used detergent storage tank, the tray having an outlet line and an inlet line, the inlet line having a pump and pump drive motor, a three-connection drain valve having (1) an inlet connected to the outlet line of the tray, (2) a first outlet connected to the varnish tank and (3) a second outlet connected to the used detergent tank, a three-connection fill valve having (1) a first inlet connected to the varnish tank, (2) a second inlet connected to the fresh detergent tank and (3) an outlet connected to the tray inlet line, and means for switching the valves and motor to produce a cleaning cycle in which (a) unused varnish is drained from the tray into the varnish tank, (b) fresh detergent is pumped to the tray from the fresh detergent tank for cleaning up the residual varnish, and (c) the used detergent is drained from the tray into the used detergent tank.

4. The combination as claimed in claim 1 or in claim 2 or in claim 3 in which means are provided for rotating the fountain roller and the applicator roller during the time the tray is filled with detergent.

5. The combination as claimed in claim 1 or in claim 2 or in claim 3 in which cyclic control means are provided for automatic sequencing of the valves and pump motor from a reference condition, said control means including manual means for initiating the sequence.

* * * * *